US010886627B2

(12) United States Patent
Chen et al.

(10) Patent No.: US 10,886,627 B2
(45) Date of Patent: Jan. 5, 2021

(54) WIDEBAND ANTENNA DEVICE

(71) Applicant: Joymax Electronics Co., Ltd., Tauyuan Hsien (TW)

(72) Inventors: Shao Yi Chen, Tauyuan Hsien (TW); Yuan-Lung Lee, Tauyuan Hsien (TW)

(73) Assignee: JOYMAX ELECTRONICS CO., LTD., Tauyuan Hsien (TW)

( * ) Notice: Subject to any disclaimer, the term of this patent is extended or adjusted under 35 U.S.C. 154(b) by 9 days.

(21) Appl. No.: 16/431,844

(22) Filed: Jun. 5, 2019

(65) Prior Publication Data

US 2020/0388933 A1 Dec. 10, 2020

(51) Int. Cl.

| | |
|---|---|
| ***H01Q 9/28*** | (2006.01) |
| ***H01Q 21/06*** | (2006.01) |
| ***H01Q 5/40*** | (2015.01) |
| ***H01Q 21/26*** | (2006.01) |
| ***H01Q 19/10*** | (2006.01) |
| ***H01Q 1/36*** | (2006.01) |

(52) U.S. Cl.

CPC ..... *H01Q 21/062* (2013.01); *H01Q 1/36* (2013.01); *H01Q 5/40* (2015.01); *H01Q 9/285* (2013.01); *H01Q 19/108* (2013.01); *H01Q 21/26* (2013.01)

(58) Field of Classification Search

CPC .... H01Q 21/062; H01Q 21/26; H01Q 19/108; H01Q 19/285; H01Q 19/065; H01Q 19/16; H01Q 19/265; H01Q 19/44; H01Q 1/36; H01Q 5/40; H01Q 5/48; H01Q 19/13

See application file for complete search history.

(56) References Cited

U.S. PATENT DOCUMENTS

| | | | | |
|---|---|---|---|---|
| 7,990,332 | B1 | 8/2011 | Tischer | |
| 8,957,824 | B2 | 2/2015 | Choi et al. | |
| 8,994,603 | B2 * | 3/2015 | Harel | H01Q 5/47 343/798 |
| 9,478,871 | B2 | 10/2016 | Hsu et al. | |
| 9,590,320 | B2 | 3/2017 | Zhang et al. | |
| 9,966,664 | B2 | 5/2018 | Katipally et al. | |
| 10,148,015 | B2 | 12/2018 | Heyde et al. | |
| 2004/0090389 | A1 * | 5/2004 | Jo | H01Q 21/26 343/797 |
| 2018/0337461 | A1 * | 11/2018 | Kildal | H01Q 9/28 |
| 2019/0103675 | A1 * | 4/2019 | McGough | H01Q 7/00 |

* cited by examiner

*Primary Examiner* — Awat M Salih

(74) *Attorney, Agent, or Firm* — Browdy and Neimark, PLLC

(57) ABSTRACT

An antenna device includes a base substrate supported on a base panel, four radiators each include an inner segment located on the base substrate, a middle segment extended from the inner segment, and an outer segment extended from the middle segment, a grounded radiating member is disposed on the bottom surface of the base panel, two feeds disposed on the bottom surface of the base panel and each having a grounded end connected to the grounded radiating member, and two radiating elements disposed on the bottom surface of the base panel, and each having a central portion connected to the feed end of the feed, and two bending sections coupled to the central portion of the radiating element, two outer sections coupled to the bending sections.

18 Claims, 7 Drawing Sheets

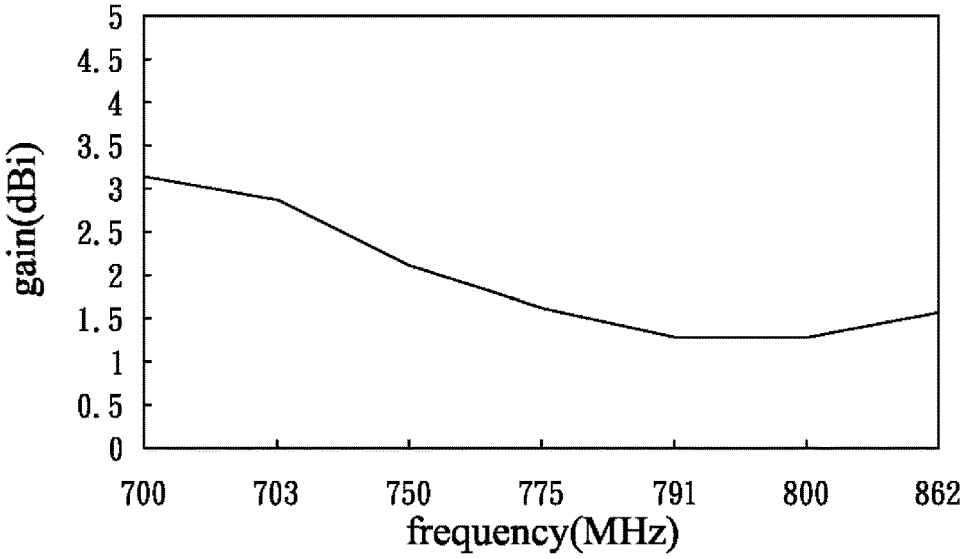
FIG. 9
| frequency(MHz) | 700 | 703 | 750 | 775 | 791 | 800 | 862 |
|---|---|---|---|---|---|---|---|
| gain(dBi) | 3.16 | 2.86 | 2.12 | 1.6 | 1.28 | 1.29 | 1.56 |
FIG. 10
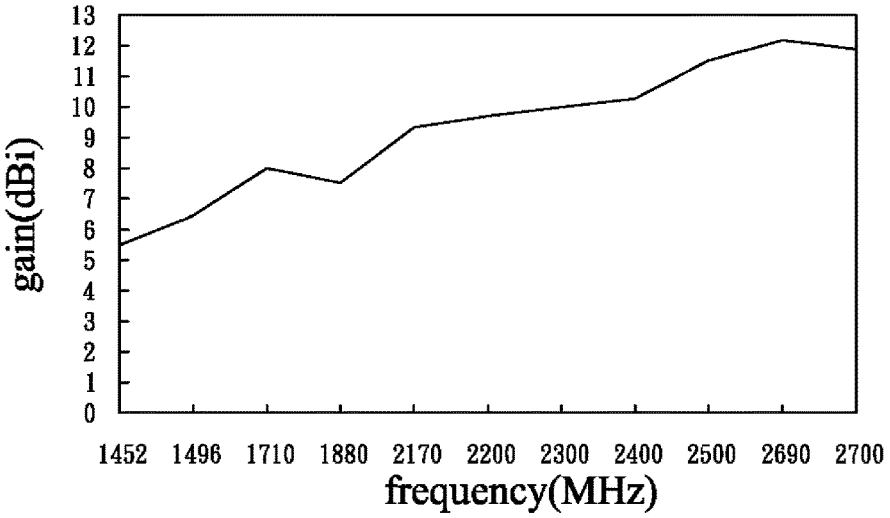
FIG. 11
| frequency(MHz) | 1452 | 1496 | 1710 | 1880 | 2170 | 2200 | 2300 | 2400 | 2500 | 2690 | 2700 |
|---|---|---|---|---|---|---|---|---|---|---|---|
| gain(dBi) | 5.56 | 6.47 | 8.06 | 7.54 | 9.36 | 9.72 | 10.00 | 10.25 | 11.55 | 12.15 | 11.91 |
FIG. 12

WIDEBAND ANTENNA DEVICE

BACKGROUND OF THE INVENTION

1. Field of the Invention

The present invention relates to a wideband or dipole antenna device, and more particularly to a wideband or dipole antenna device including an improved and simplified structure or configuration for suitably receiving dipole radiation pattern and for solving the problem of the limited bandwidth of the conventional antennas.

2. Description of the Prior Art

Various kinds of typical wideband or dipole antenna devices have been developed and provided for wireless communication purposes and the typical wideband or dipole antenna devices cover different spectrums to meet demands of multimedia wideband communication, such as 2G/3G/4G wireless communication protocols, Wi-Fi, Global Position System (GPS), and the like.

For example, U.S. Pat. No. 7,990,332 B1 to Tischer, U.S. Pat. No. 8,957,824 B2 to Choi et al., U.S. Pat. No. 9,478,871 B2 to Hsu et al., U.S. Pat. No. 9,590,320 B2 to Zhang et al., U.S. Pat. No. 9,966,664 B2 to Katipally et al., and U.S. Pat. No. 10,148,015 B2 to Heyde et al. disclose several of the typical wideband or dipole antenna devices each comprising a designed structure or configuration for receiving dipole radiation pattern and the like.

However, the gain for the typical wideband or dipole antenna devices is usually low, and the typical antenna devices may not meet default radiation demands.

The present invention has arisen to mitigate and/or obviate the afore-described disadvantages of the conventional wideband antenna devices.

SUMMARY OF THE INVENTION

The primary objective of the present invention is to provide a wideband or dipole antenna device including an improved and simplified structure or configuration for suitably receiving dipole radiation pattern and for solving the problem of the limited bandwidth of the conventional antennas.

In accordance with one aspect of the invention, there is provided an antenna device comprising a base panel including a bottom surface, a base substrate supported on the base panel, a first radiator including an inner segment located on the base substrate, a middle segment extended from the inner segment, and an outer segment extended from the middle segment, a second radiator located opposite to the first radiator, the second radiator including an inner segment located on the base substrate, a middle segment extended from the inner segment of the second radiator, and an outer segment extended from the middle segment of the second radiator, a third radiator located between the first radiator and the second radiator, the third radiator including an inner segment located on the base substrate, a middle segment extended from the inner segment of the third radiator, and an outer segment extended from the middle segment of the third radiator, a fourth radiator located between the first radiator and the second radiator and located opposite to the third radiator, the fourth radiator including an inner segment located on the base substrate, a middle segment extended from the inner segment of the fourth radiator, and an outer segment extended from the middle segment of the fourth radiator, a grounded radiating member provided on the bottom surface of the base panel, two feeds provided on the bottom surface of the base panel, the feeds each including a feed end, and a grounded end connected to the grounded radiating member, and a first radiating element provided on the bottom surface of the base panel, and the first radiating element including a central portion connected to the feed end of the respective feed, two bending sections coupled to the central portion of the first radiating element, two outer sections coupled to the bending sections of the first radiating element respectively, and the outer sections of the first radiating element each including a groove formed in the respective outer section, and a second radiating element provided on the bottom surface of the base panel, and the second radiating element including a central portion connected to the feed end of the respective feed, two bending sections coupled to the central portion of the second radiating element, two outer sections coupled to the bending sections of the second radiating element respectively, and the outer sections of the second radiating element each including a groove formed in the respective outer section.

The inner segment of the first radiator is located on an upper surface of the base substrate. The inner segment of the first radiator includes a triangular structure.

The inner segment of the second radiator is located on an upper surface of the base substrate and located opposite to the inner segment of the first radiator. The inner segment of the second radiator includes a triangular structure or the like.

The inner segment of the third radiator is located on a lower surface of the base substrate and located opposite to the inner segment of the fourth radiator. The inner segment of the third radiator includes a triangular structure or the like.

The inner segment of the fourth radiator is located on a lower surface of the base substrate and located opposite to the inner segment of the third radiator. The inner segment of the fourth radiator includes a triangular structure or the like.

The base panel includes two spaces formed in the bottom surface of the base panel, and the first and the second radiating elements are provided in the spaces that are formed in the bottom surface of the base panel. The base panel includes two conductors connected to the feed ends of the feeds respectively.

The inner segment and the outer segment of the first radiator are located at different height. The inner segment and the outer segment of the second radiator are located at different height. The inner segment and the outer segment of the third radiator are located at different height. The inner segment and the outer segment of the fourth radiator are located at different height.

The base panel includes a plurality of poles extended upwardly therefrom and engaged with the first and the second and the third and the fourth radiators. The first and the second and the third and the fourth radiators each include an opening formed therein for forming two separated outer segments.

An antenna radiation guiding substrate may further be provided and supported on the base substrate, and a guiding patch provided on the antenna radiation guiding substrate.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 9 is a further diagram illustrating the gain/frequency of the antenna device operated in the frequency band ranged from 700 to 862 MHz;

FIG. 10 is a chart illustrating the antenna characteristic data description of the antenna device as shown in FIG. 9;

FIG. 11 is a still further diagram illustrating the gain/frequency of the antenna device operated in the frequency band ranged from 1452 to 2700 MHz; and FIG. 12 is another chart illustrating the antenna characteristic data description of the antenna device as shown in FIG. 11.

DETAILED DESCRIPTION OF THE PREFERRED EMBODIMENT

Figure 1:
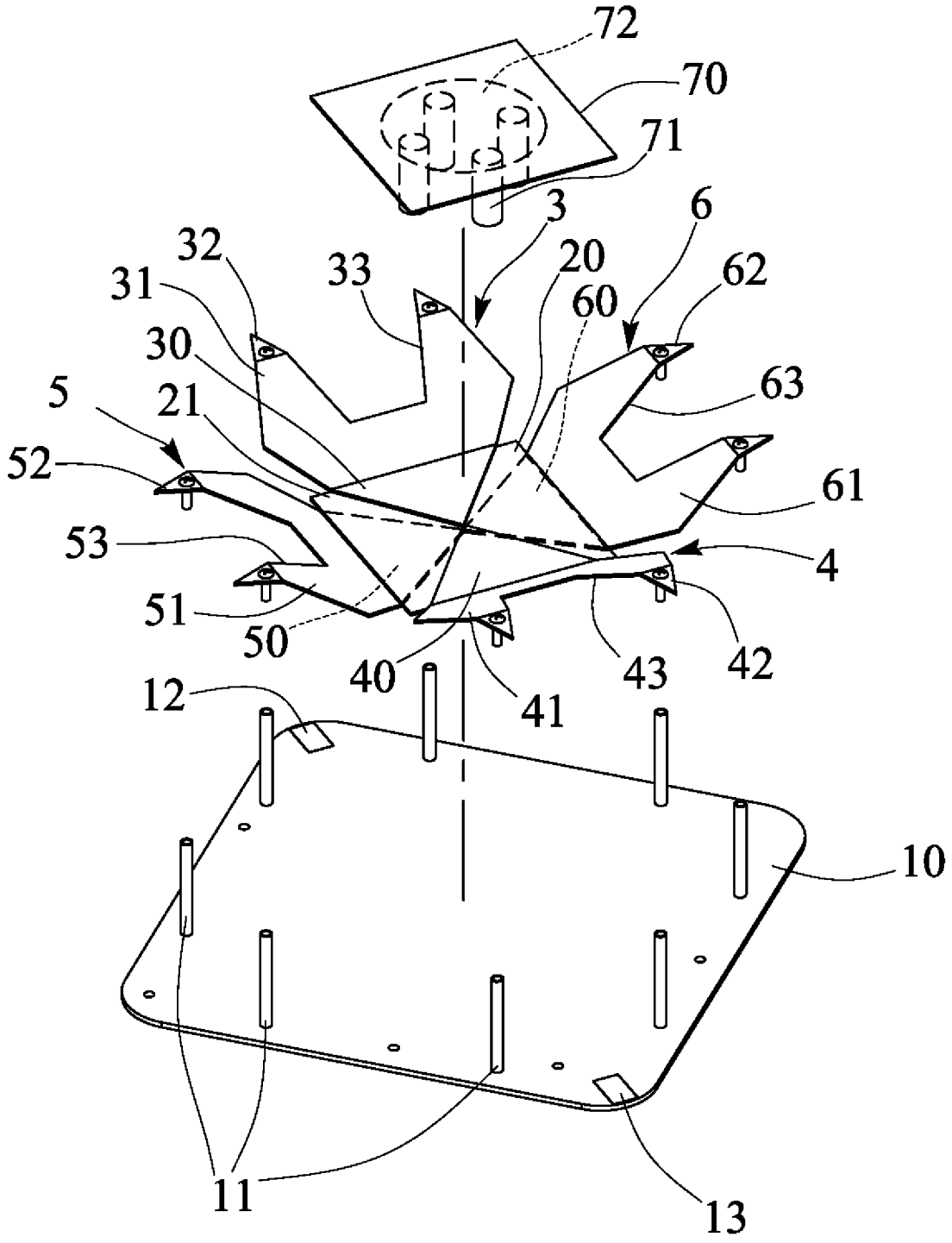
FIG. 1 is a partial exploded view of a wideband or dipole antenna device in accordance with the present invention.
Figure 2:
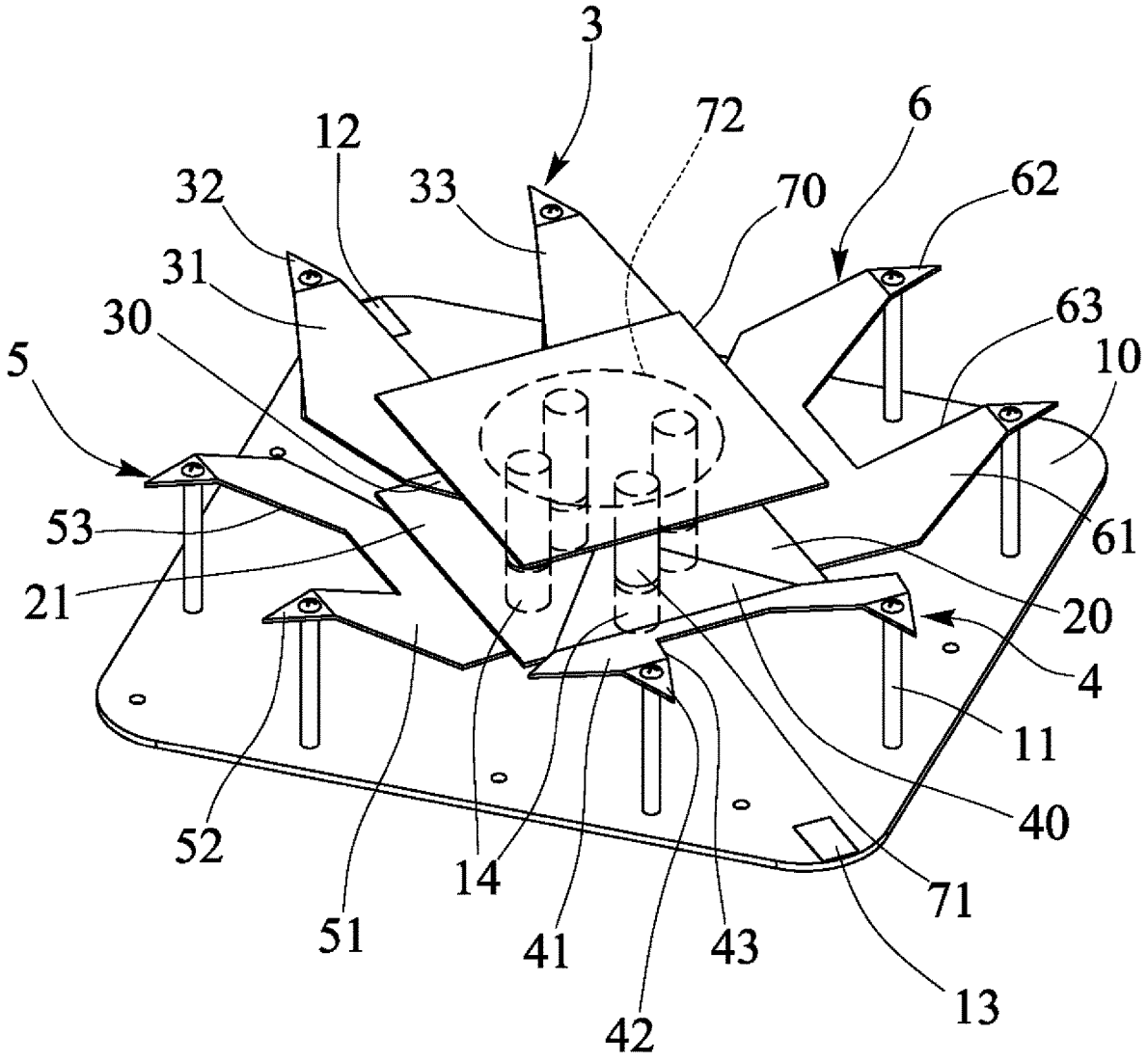
FIG. 2 is a perspective view of the wideband or dipole antenna device.
Figure 3:
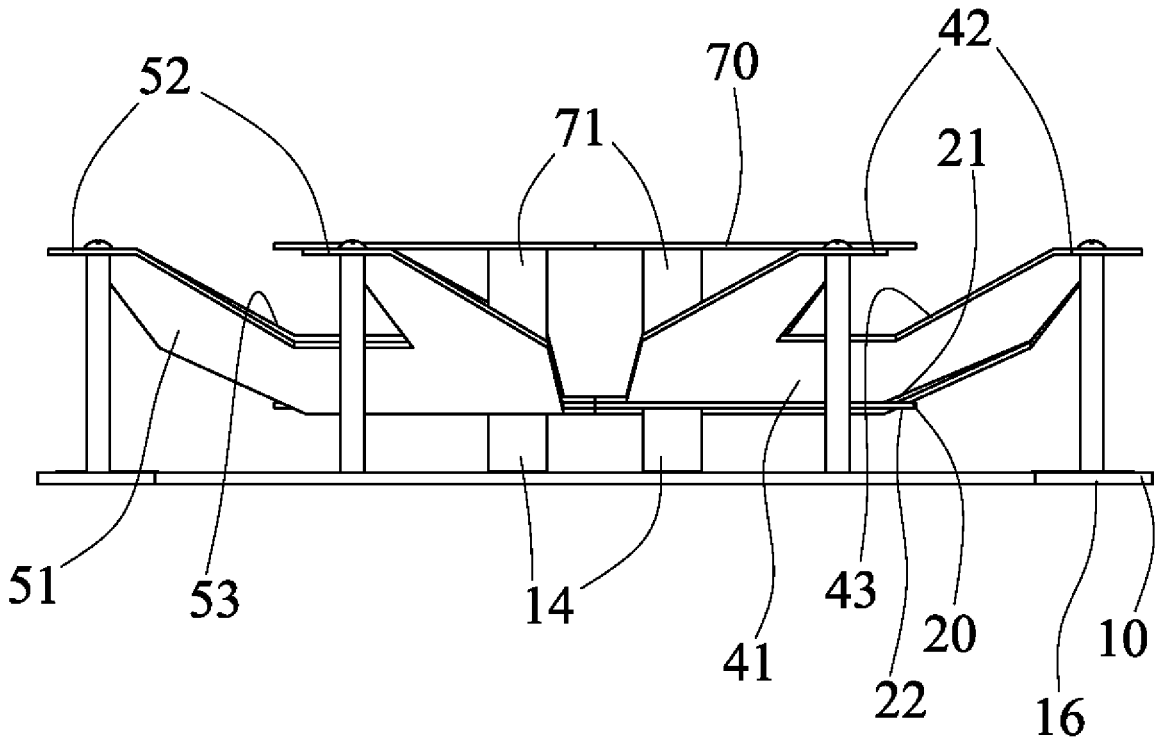
FIG. 3 is a side plan schematic view of the wideband antenna device.

Referring to the drawings, and initially to FIGS. 1-3, a wideband or dipole antenna device in accordance with the present invention comprises a bottom or base panel 10 including one or more (such as eight or four pairs of) columns or poles 11 extended upwardly therefrom, and preferable, but not necessary that the poles 11 are equally spaced from each other, and further including one or more (such as two) antenna matching components or conductors 12, 13 formed or provided thereon, such as disposed and arranged or located opposite to each other, and such as disposed at the two opposite corner areas. A base substrate 20 is disposed and supported on or above the base panel 10 with one or more (such as four) poles or studs 14 and spaced or separated from the base panel 10, best shown in FIG. 3.

One or more (such as two pairs or four) radiators 3, 4, 5, 6 are disposed and supported on or attached or mounted or secured to the base substrate 20. For example, the first and the second radiators 3, 4 are disposed and arranged opposite to each other, and the third and the fourth radiators 5, 6 are also disposed and arranged opposite to each other, and disposed and located beside or between the first and the second radiators 3, 4 respectively. The radiators 3, 4, 5, 6 each include a lower or first or inner portion or segment 30, 40, 50, 60 formed or provided on or attached or mounted or secured to the base substrate 20, and preferable, but not necessary that the inner segments 30, 40, 50, 60 each include a triangular structure or configuration, in which the inner segments 30, 40 of the first and the second radiators 3, 4 are disposed and located on the upper portion or surface 21 of the base substrate 20, and the inner segments 50, 60 of the third and the fourth radiators 5, 6 are disposed and located on the lower or bottom portion or surface 22 of the base substrate 20.

The inner segments 30, 40, 50, 60 of the radiators 3, 4, 5, 6 may be directly formed or provided on the base substrate 20 with laser engraving or etching procedures or the like, or may be attached or mounted or secured to the base substrate 20 with welders or the like. The radiators 3, 4, 5, 6 each further include an intermediate or middle or second portion or segment 31, 41, 51, 61 extended from the inner segments 30, 40, 50, 60 and tilted or inclined relative to the inner segments 30, 40, 50, 60 respectively, and one or more (such as two) outer or third or upper portions or segments 32, 42, 52, 62 extended from the middle segment 31, 41, 51, 61 and tilted or inclined relative to the middle segment 31, 41, 51, 61 respectively, it is preferable, but not necessary that the outer segments 32, 42, 52, 62 and parallel to the inner segments 30, 40, 50, 60 and the base substrate 20 and attached or mounted or secured to and supported on the poles 11 respectively for allowing the radiators 3, 4, 5, 6 to be solidly and stably supported on the base substrate 20.

The radiators 3, 4, 5, 6 each may include a notch or opening 33, 43, 53, 63 formed or provided therein for forming or defining the two separated outer segments 32, 42, 52, 62 for the respective radiator 3, 4, 5, 6. The outer segments 32, 42, 52, 62 and the inner segments 30, 40, 50, 60 of the radiators 3, 4, 5, 6 are arranged or located at different height for forming a bent and spatial structure or configuration for the radiators 3, 4, 5, 6 that are suitable for being actuated or operated in the higher frequency band ranged from 1700 to 2700 MHz, and the radiators 3, 4, 5, 6 include a compact structure or configuration that may be easily and quickly and readily connected or coupled to the electric circuits (not illustrated) or the like. An antenna radiation guiding substrate 70 may further be provided and attached or mounted or supported on the base substrate 20 with one or more (such as four) poles or posts 71, and an antenna member or guiding patch 72 is formed or provided on the antenna radiation guiding substrate 70 for increasing the wave guiding effect and the directivity gain of the wideband or dipole antenna device in accordance with the present invention.

Figure 4:
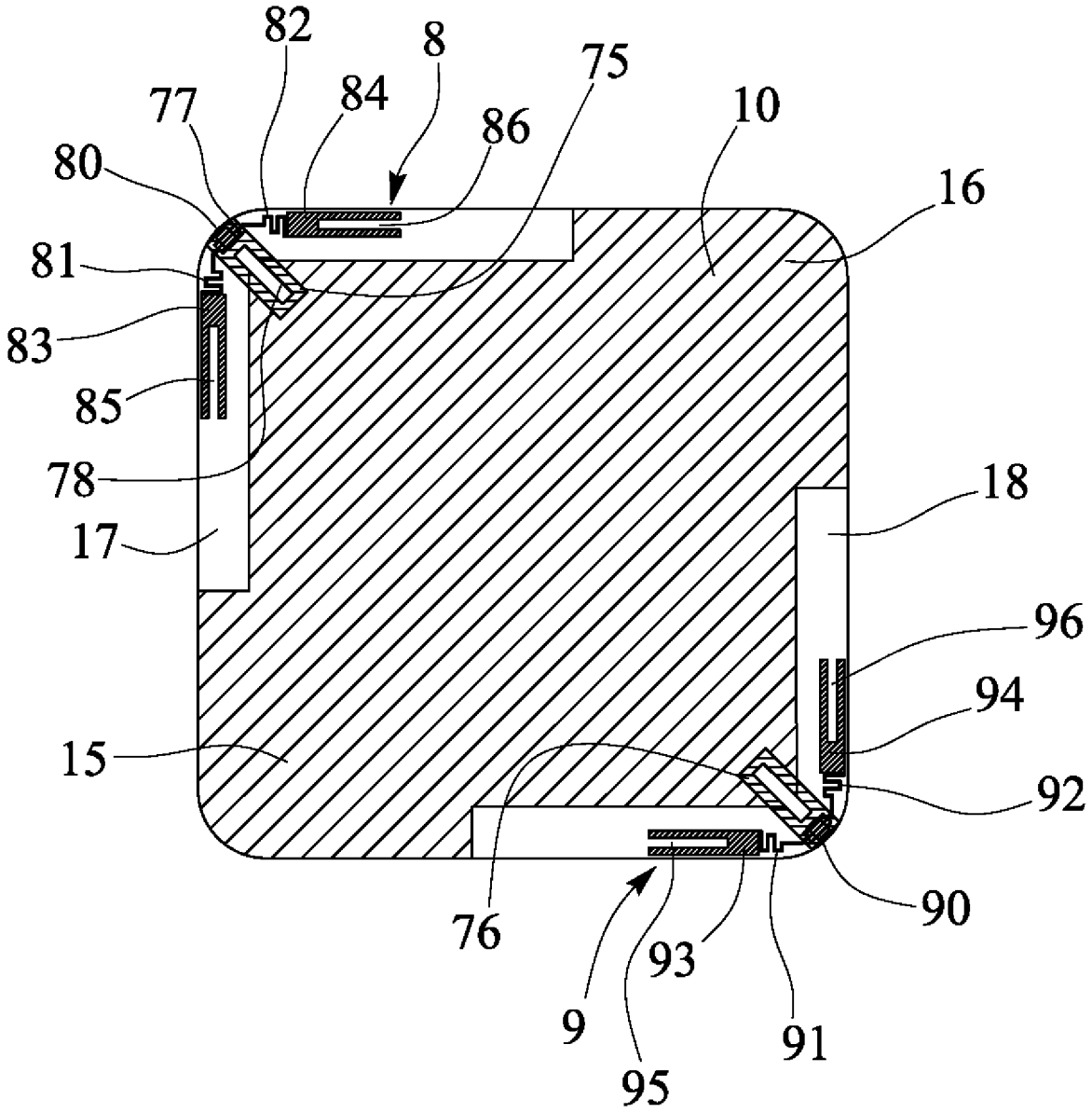
FIG. 4 is a bottom plan schematic view of the wideband or dipole antenna device.
Figure 5:
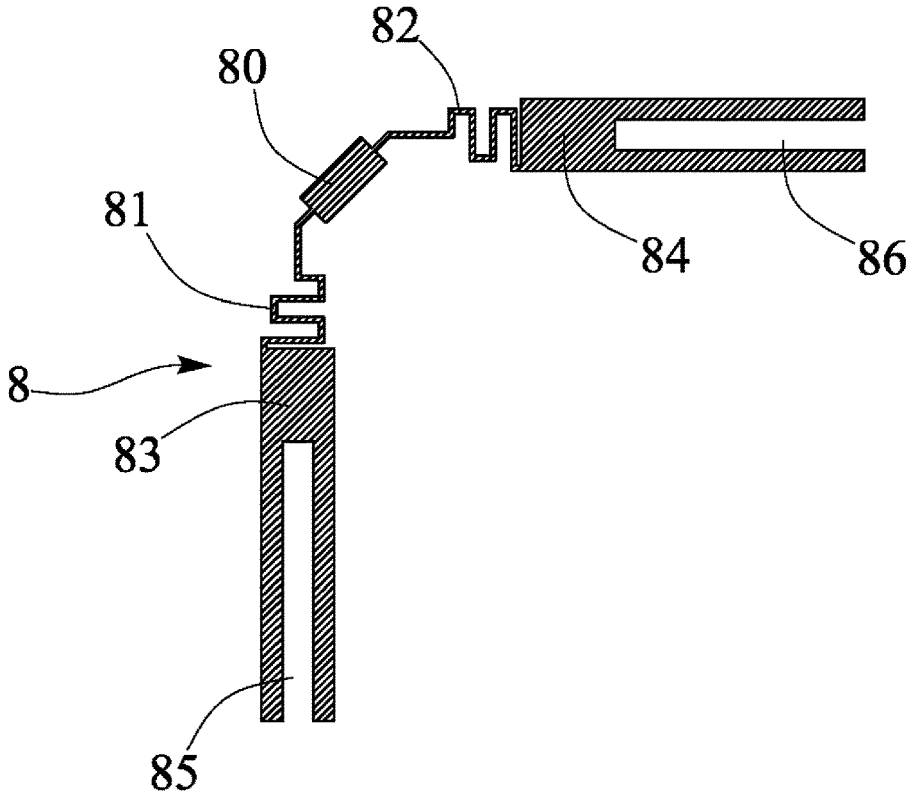
FIGS. 5, 6 are enlarged partial bottom plan schematic views of the wideband or dipole antenna device.
Figure 6:
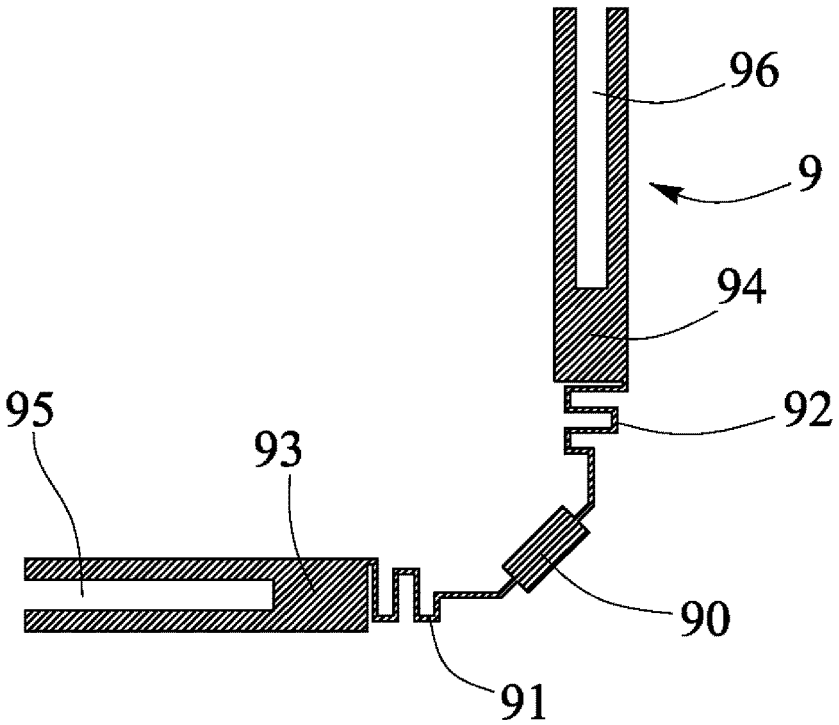

As shown in FIGS. 4-6, the base panel 10 includes a grounded radiating member 15 formed or provided on the lower or bottom portion or surface 16 of the base panel 10, and includes one or more (such as two) L-shaped spaces 17, 18 formed or provided in the bottom surface 16 of the base panel 10 and disposed and arranged or located opposite to each other, where the grounded radiating member 15 is not formed or provided thereon. The grounded radiating member 15 may be formed or provided on the base panel 10 with laser engraving or etching procedures or the like. The base panel 10 further includes one or more (such as two) feeds 75, 76 formed or provided on the bottom surface 16 of the base panel 10 and arranged or located in the spaces 17, 18 of the base panel 10, and the first and the second feeds 75, 76 each include a feed end 77 for connecting or coupling to the conductors 12, 13 respectively or selectively, and a grounded end 78 connected or coupled to the grounded radiating member 15.

One or more (such as two) radiating elements 8, 9 are may further be formed or provided on or attached or mounted or secured to the bottom surface 16 of the base panel 10 and arranged or located in the spaces 17, 18 of the base panel 10, and the first and the second radiating elements 8, 9 each include a middle or central portion 80, 90 connected or coupled to the feed end 77 of the respective feed 75, 76, two folding or bending sections 81, 82; 91, 92 connected or coupled to or extended from the central portion 80, 90 and/or connected or coupled to the feed ends 77 of the feeds 75, 76 respectively, two outer sections 83, 84; 93, 94 connected or coupled to or extended from the bending sections 81, 82; 91, 92 respectively, and the outer sections 83, 84; 93, 94 each include a slot or groove 85 86; 95, 96 formed or provided therein, and the grounded radiating member 15 and/or the feeds 75, 76 and/or the radiating elements 8, 9 may be provided for forming or defining a reflecting substrate for the wideband or dipole antenna device and may be provided for being actuated or operated in the lower frequency band ranged from 700 to 862 MHz.

Figure 7:
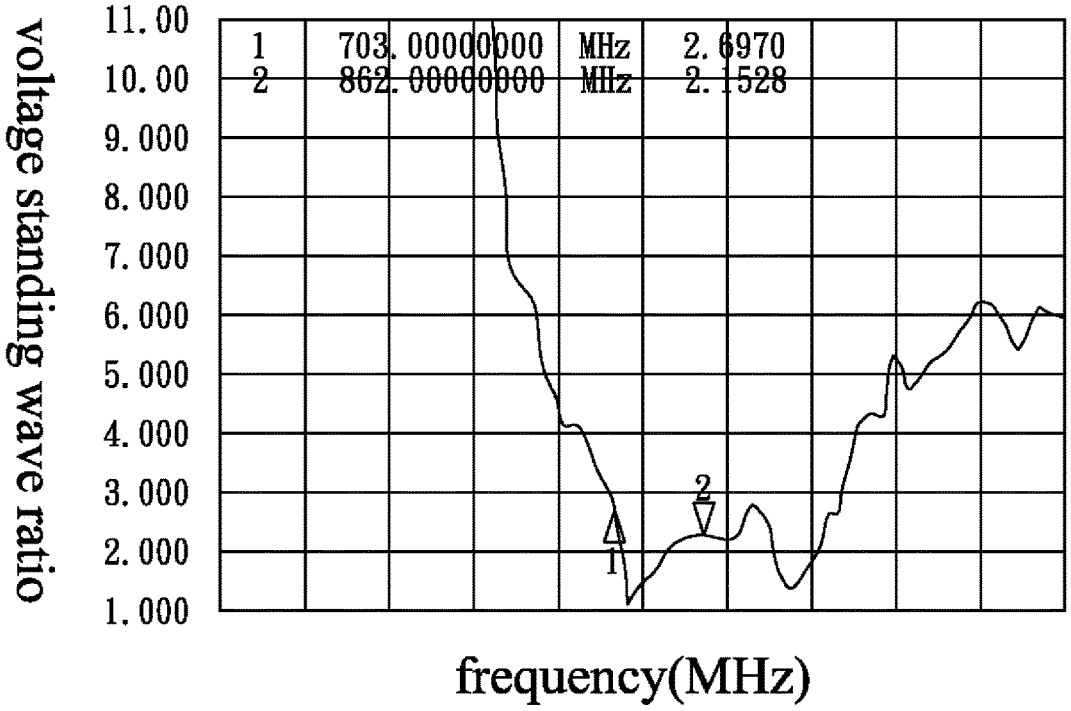
FIG. 7 is a diagram illustrating the voltage standing wave ratio of the antenna device operated in the frequency band ranged from 700 to 862 MHz.
Figure 8:
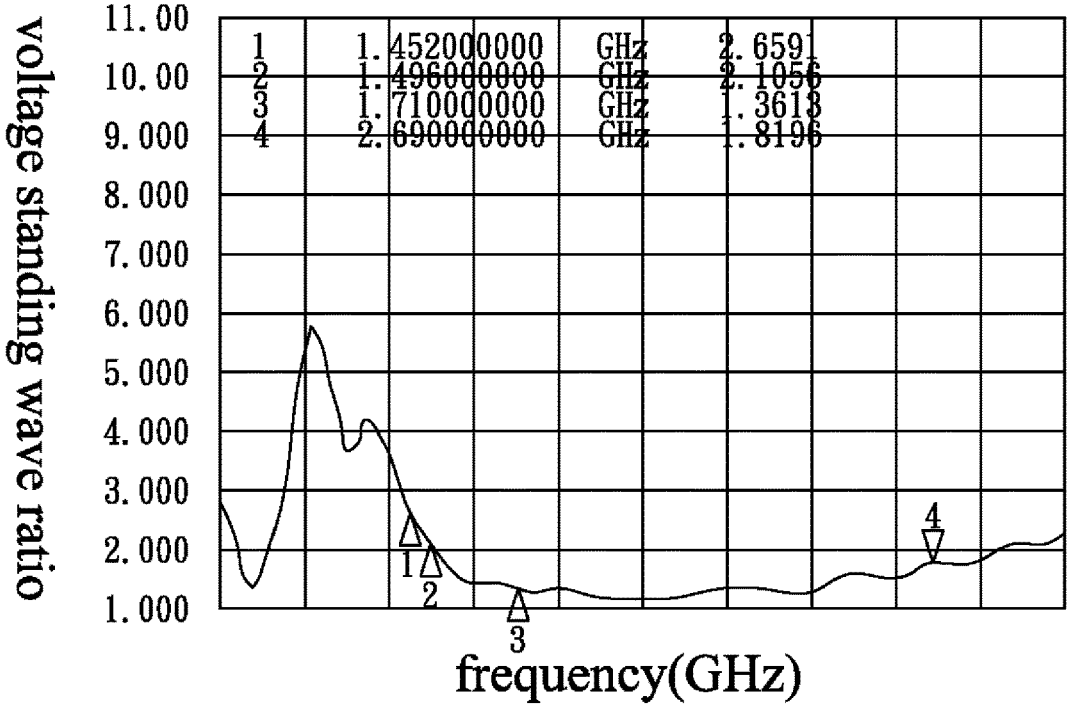
FIG. 8 is another diagram illustrating the voltage standing wave ratio of the antenna device operated in the frequency band ranged from 1452 to 2700 MHz.

As shown in FIGS. 7 and 8, the voltage standing wave ratio and the impedance matching for the high and low frequency response of the wideband or dipole antenna device in accordance with the present invention includes a good characteristic for allowing the antenna transceiver effect to be improved. As shown in FIGS. 9-12, the good characteristics for the gain allow the wideband or dipole antenna device to be suitable for the long term evolution (LTE) wireless communication system which supports the multi-input multi-output (MIMO) communication technology.

Accordingly, the wideband or dipole antenna device in accordance with the present invention includes an improved and simplified structure or configuration for suitably receiving dipole radiation pattern and for solving the problem of the limited bandwidth of the conventional antennas.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An antenna device comprising:

a base panel including a bottom surface, a base substrate supported on said base panel, a first radiator including an inner segment located on said base substrate, a middle segment extended from said inner segment, and an outer segment extended from said middle segment, a second radiator located opposite to said first radiator, said second radiator including an inner segment located on said base substrate, a middle segment extended from said inner segment of said second radiator, and an outer segment extended from said middle segment of said second radiator, a third radiator located between said first radiator and said second radiator, said third radiator including an inner segment located on said base substrate, a middle segment extended from said inner segment of said third radiator, and an outer segment extended from said middle segment of said third radiator, a fourth radiator located between said first radiator and said second radiator and located opposite to said third radiator, said fourth radiator including an inner segment located on said base substrate, a middle segment extended from said inner segment of said fourth radiator, and an outer segment extended from said middle segment of said fourth radiator, a grounded radiating member provided on said bottom surface of said base panel, two feeds provided on said bottom surface of said base panel, said feeds each including a feed end, and a grounded end connected to said grounded radiating member, a first radiating element provided on said bottom surface of said base panel, and said first radiating element including a central portion connected to said feed end of said respective feed, two bending sections coupled to said central portion of said first radiating element, two outer sections coupled to said bending sections of said first radiating element respectively, and said outer sections of said first radiating element each including a groove formed in said respective outer section, and a second radiating element provided on said bottom surface of said base panel, and said second radiating element including a central portion connected to said feed end of said respective feed, two bending sections coupled to said central portion of said second radiating element, two outer sections coupled to said bending sections of said second radiating element respectively, and said outer sections of said second radiating element each including a groove formed in said respective outer section.

2. The antenna device as claimed in claim 1, wherein said inner segment of said first radiator is located on an upper surface of said base substrate.

3. The antenna device as claimed in claim 2, wherein said inner segment of said first radiator includes a triangular structure.

4. The antenna device as claimed in claim 1, wherein said inner segment of said second radiator is located on an upper surface of said base substrate and located opposite to said inner segment of said first radiator.

5. The antenna device as claimed in claim 4, wherein said inner segment of said second radiator includes a triangular structure.

6. The antenna device as claimed in claim 1, wherein said inner segment of said third radiator is located on a lower surface of said base substrate and located opposite to said inner segment of said fourth radiator.

7. The antenna device as claimed in claim 6, wherein said inner segment of said third radiator includes a triangular structure.

8. The antenna device as claimed in claim 1, wherein said inner segment of said fourth radiator is located on a lower surface of said base substrate and located opposite to said inner segment of said third radiator.

9. The antenna device as claimed in claim 8, wherein said inner segment of said fourth radiator includes a triangular structure.

10. The antenna device as claimed in claim 1, wherein said base panel includes two spaces formed in said bottom surface of said base panel, and said first and said second radiating elements are provided in said spaces that are formed in said bottom surface of said base panel.

11. The antenna device as claimed in claim 1, wherein said base panel includes two conductors connected to said feed ends of said feeds respectively.

12. The antenna device as claimed in claim 1, wherein said inner segment and said outer segment of said first radiator are located at different height.

13. The antenna device as claimed in claim 1, wherein said inner segment and said outer segment of said second radiator are located at different height.

14. The antenna device as claimed in claim 1, wherein said inner segment and said outer segment of said third radiator are located at different height.

15. The antenna device as claimed in claim 1, wherein said inner segment and said outer segment of said fourth radiator are located at different height.

16. The antenna device as claimed in claim 1, wherein said base panel includes a plurality of poles extended upwardly therefrom and engaged with said first and said second and said third and said fourth radiators.

17. The antenna device as claimed in claim 1, wherein said first and said second and said third and said fourth radiators each include an opening formed therein for forming two separated outer segments.

18. The antenna device as claimed in claim 1 further comprising an antenna radiation guiding substrate supported on said base substrate, and a guiding patch provided on said antenna radiation guiding substrate.

* * * * *